US011455932B2

(12) United States Patent
Pyun et al.

(10) Patent No.: US 11,455,932 B2
(45) Date of Patent: Sep. 27, 2022

(54) DRIVING CONTROLLER, DISPLAY APPARATUS INCLUDING THE SAME AND METHOD OF DRIVING DISPLAY PANEL USING THE SAME

(71) Applicant: Samsung Display Co., Ltd., Yongin-Si (KR)

(72) Inventors: Kihyun Pyun, Gwangmyeong-si (KR); Heesook Park, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/235,161

(22) Filed: Apr. 20, 2021

(65) Prior Publication Data

US 2021/0375181 A1 Dec. 2, 2021

(30) Foreign Application Priority Data

Jun. 2, 2020 (KR) ..... 10-2020-0066460

(51) Int. Cl.
*G09G 3/20* (2006.01)

(52) U.S. Cl.
CPC ..... *G09G 3/2003* (2013.01); *G09G 2310/027* (2013.01); *G09G 2320/0626* (2013.01); *G09G 2320/0673* (2013.01)

(58) Field of Classification Search
CPC ..... G09G 3/2003; G09G 2310/027; G09G 2320/0626; G09G 2320/0673
See application file for complete search history.

(56) References Cited

U.S. PATENT DOCUMENTS

2014/0160178 A1 6/2014 Hong et al.
2018/0182297 A1* 6/2018 Lee ..... G09G 3/2077

FOREIGN PATENT DOCUMENTS

KR 1020060122307 A 11/2006
KR 100836986 B1 6/2008
KR 101676878 B1 11/2016
WO 2012134162 A2 10/2012

OTHER PUBLICATIONS

Extended European Search Report for Application No. 21177365.0-1209 dated Sep. 30, 2021.

* cited by examiner

*Primary Examiner* — Kenneth B Lee, Jr.
(74) *Attorney, Agent, or Firm* — Cantor Colburn LLP

(57) ABSTRACT

A driving controller includes an image analyzer, a grayscale setter and a time-and-space arranger. The image analyzer analyzes input image data to determine a peak luminance. The grayscale setter receives a gamma value and the peak luminance and to determine a boundary grayscale value and a minimum grayscale value. The time-and-space arranger is configured to temporally and spatially arrange first data having the boundary grayscale value and second data having the minimum grayscale value. The driving controller is configured to drive a display panel using the first data and the second data for a low grayscale range of which a grayscale is equal to or less than the boundary grayscale value and to drive the display panel based on a data signal corresponding to a grayscale value of the input image data for a normal grayscale range of which a grayscale is greater than the boundary grayscale value.

25 Claims, 13 Drawing Sheets

32GRAY
(BLACK 0% DENSITY)

24GRAY
(BLACK 25% DENSITY)

16GRAY
(BLACK 50% DENSITY)

8GRAY
(BLACK 75% DENSITY)

0GRAY
(BLACK 100% DENSITY)

| GRAYSCALE VALUE | BOUNDARY GRAYSCALE VALUE | MINIMUM GRAYSCALE VALUE |
|---|---|---|
| 31G~23G | 32G | 0G |
| 22G~17G | 23G | 0G |
| 16G~12G | 17G | 0G |
| 11G~8G | 12G | 0G |
| 7G~4G | 8G | 0G |
| 3G~0G | 4G | 0G |

| GRAYSCALE VALUE | BOUNDARY GRAYSCALE VALUE | MINIMUM GRAYSCALE VALUE |
|---|---|---|
| 31G~23G | 32G | 23G |
| 22G~17G | 23G | 17G |
| 16G~12G | 17G | 12G |
| 11G~8G | 12G | 8G |
| 7G~4G | 8G | 4G |
| 3G~0G | 4G | 0G |

| GRAYSCALE VALUE | BOUNDARY GRAYSCALE VALUE | MINIMUM GRAYSCALE VALUE |
|---|---|---|
| 31G~19G | 32G | 0G |
| 18G~11G | 19G | 0G |
| 10G~0G | 11G | 0G |

| GRAYSCALE VALUE | BOUNDARY GRAYSCALE VALUE | MINIMUM GRAYSCALE VALUE |
|---|---|---|
| 31G~19G | 32G | 19G |
| 18G~11G | 19G | 11G |
| 10G~0G | 11G | 0G |

DRIVING CONTROLLER, DISPLAY APPARATUS INCLUDING THE SAME AND METHOD OF DRIVING DISPLAY PANEL USING THE SAME

This application claims priority to Korean Patent Application No. 10-2020-0066460, filed on Jun. 2, 2020, and all the benefits accruing therefrom under 35 U.S.C. § 119, the content of which in its entirety is herein incorporated by reference.

BACKGROUND

1. Field

Embodiments of the present inventive concept relate to a driving controller, a display apparatus including the driving controller and a method of driving a display panel using the display apparatus. More particularly, embodiments of the present inventive concept relate to a driving controller enhancing a display quality, a display apparatus including the driving controller and a method of driving a display panel using the display apparatus.

2. Description of the Related Art

Generally, a display apparatus includes a display panel and a display panel driver. The display panel displays an image based on input image data. The display panel includes a plurality of gate lines, a plurality of data lines and a plurality of pixels. The display panel driver includes a gate driver, a data driver and a driving controller. The gate driver outputs gate signals to the gate lines. The data driver outputs data voltages to the data lines. The driving controller controls the gate driver and the data driver.

In a low grayscale range, a gamma value of a display image may be likely to deviate from a target gamma value, a color coordinate of the display image may be likely to deviate from a target color coordinate and a stain may be shown to a user according to the characteristics of the display panel.

SUMMARY

Embodiments of the present inventive concept provide a driving controller driving a display panel in a digital driving method corresponding to a low grayscale range, driving the display panel in an analog driving method corresponding to a normal grayscale range which is not the low grayscale range and setting a boundary grayscale value representing the grayscale value of a boundary of the low grayscale range and the normal grayscale range according to input image data to enhance a display quality.

Embodiments of the present inventive concept also provide a display apparatus including the driving controller.

Embodiments of the present inventive concept also provide a method of driving a display panel using the display apparatus.

In an embodiment of a driving controller according to the present inventive concept, the driving controller includes an image analyzer, a grayscale setter and a time-and-space arranger. The image analyzer is configured to analyze input image data to determine a peak luminance. The grayscale setter is configured to receive a gamma value and the peak luminance and to set a boundary grayscale value and a minimum grayscale value. The time-and-space arranger is configured to temporally and spatially arrange first data having the boundary grayscale value and second data having the minimum grayscale value. The driving controller is configured to drive a display panel using the first data and the second data for a low grayscale range of which a grayscale is equal to or less than the boundary grayscale value and to drive the display panel based on a data signal corresponding to a grayscale value of the input image data for a normal grayscale range of which a grayscale is greater than the boundary grayscale value.

In an embodiment, the grayscale setter may be configured to set the boundary grayscale value and the minimum grayscale value such that a difference between the boundary grayscale value and the minimum grayscale value is decreased as the peak luminance increases.

In an embodiment, the minimum grayscale value may be fixed. The boundary grayscale value may be set to be decreased by the grayscale setter as the peak luminance increases.

In an embodiment, the grayscale setter may be configured to set the boundary grayscale value and the minimum grayscale value such that a difference between the boundary grayscale value and the minimum grayscale value is decreased as the gamma value decreases.

In an embodiment, wherein the minimum grayscale value may be fixed. The boundary grayscale value may be decreased as the gamma value decreases.

In an embodiment, the grayscale setter may be configured to define a plurality of digital driving grayscale ranges. The grayscale setter may be configured to set a first boundary grayscale value and a first minimum grayscale value for a first input grayscale range. The grayscale setter may be configured to set a second boundary grayscale value and a second minimum grayscale value for a second input grayscale range which has lower grayscale values than grayscale values of the first input grayscale range.

In an embodiment, first boundary grayscale value may be greater than the second boundary grayscale value.

In an embodiment, the first minimum grayscale value may be equal to the second minimum grayscale value.

In an embodiment, the first minimum grayscale value may be greater than the second minimum grayscale value.

In an embodiment, the driving controller may further include a halftone setter which sets a maximum value of a number of pixels having the minimum grayscale value based on the boundary grayscale value, the minimum grayscale value and the gamma value.

In an embodiment, the maximum value of the number of pixels having the minimum grayscale value may be decreased as a luminance difference of the boundary grayscale value and the minimum grayscale value increases.

In an embodiment, the grayscale setter may be configured to define a plurality of digital driving grayscale ranges. The grayscale setter may be configured to set a first boundary grayscale value and a first minimum grayscale value for a first input grayscale range. The grayscale setter may be configured to set a second boundary grayscale value and a second minimum grayscale value for a second input grayscale range which has lower grayscale values than grayscale values of the first input grayscale range.

In an embodiment, the halftone setter may be configured to set the maximum value of the number of pixels having the minimum grayscale value to be fixed regardless of an input grayscale value of the input image data.

In an embodiment, the halftone setter may be configured to set the maximum value of the number of pixels having the minimum grayscale value to be varied according to an input grayscale value of the input image data.

In an embodiment, the maximum value of the number of pixels having the minimum grayscale value may be increased as the input grayscale value of the input image data decreases.

In an embodiment, the grayscale setter may be configured to further receive characteristic values of a red subpixel, a green subpixel and a blue subpixel. The grayscale setter may be configured to set boundary grayscale values of the red subpixel, the green subpixel and the blue subpixel and the minimum grayscale values of the red subpixel, the green subpixel and the blue subpixel based on the gamma value, the peak luminance and the characteristic values of the red subpixel, the green subpixel and the blue subpixel, respectively.

In an embodiment, the driving controller may further include a halftone setter which sets a maximum value of the number of pixels having the minimum grayscale value of the red subpixel, a maximum value of the number of pixels having the minimum grayscale value of the green subpixel and a maximum value of the number of pixels having the minimum grayscale value of the blue subpixel based on the boundary grayscale values of the red subpixel, the green subpixel and the blue subpixel, the minimum grayscale values of the red subpixel, the green subpixel and the blue subpixel and the gamma value.

In an embodiment of a display apparatus according to the present inventive concept, the display apparatus includes a display panel, a gate driver, a driving controller and a data driver. The display panel is configured to display an image based on input image data. The gate driver is configured to output a gate signal to the display panel. The driving controller is configured to analyze input image data to determine a peak luminance, to set a boundary grayscale value and a minimum grayscale value based on a gamma value and the peak luminance, to temporally and spatially arrange first data having the boundary grayscale value and second data having the minimum grayscale value to generate a data signal, to drive the display panel for a low grayscale range in a digital driving method and to drive the display panel for a normal grayscale range of which a grayscale is greater than the boundary grayscale value in an analog driving method. The boundary grayscale value is a grayscale value of a boundary between the normal grayscale range and the normal grayscale range. The data driver is configured to generate a data voltage based on the data signal and to output the data voltage to the display panel.

In an embodiment, the driving controller may be configured to set a maximum value of a number of pixels having the minimum grayscale value based on the boundary grayscale value, the minimum grayscale value and the gamma value.

In an embodiment of a method of driving a display panel according to the present inventive concept, the method includes analyzing input image data to determine a peak luminance, setting a boundary grayscale value and a minimum grayscale value based on a gamma value and the peak luminance and temporally and spatially arranging first data having the boundary grayscale value and second data having the minimum grayscale value to generate a data signal.

In an embodiment, the method may further include converting the data signal into a data voltage and outputting the data voltage to the display panel.

In an embodiment, the boundary grayscale value and the minimum grayscale value may be set such that a difference between the boundary grayscale value and the minimum grayscale value is decreased as the peak luminance increases.

In an embodiment, the minimum grayscale value may be fixed. The boundary grayscale value may be decreased as the peak luminance increases.

In an embodiment, the boundary grayscale value and the minimum grayscale value may be set such that a difference between the boundary grayscale value and the minimum grayscale value is decreased as the gamma value decreases.

In an embodiment, the minimum grayscale value may be fixed. The boundary grayscale value may be decreased as the gamma value decreases.

According to the driving controller, the display apparatus and the method of driving the display panel, the display panel may be driven in the digital driving method corresponding to the low grayscale range, the display panel may be driven in the analog driving method corresponding to the normal grayscale range which is not the low grayscale range and the boundary grayscale value representing the grayscale value of the boundary of the low grayscale range and the normal grayscale range and the minimum grayscale value may be determined adaptively.

Thus, the difference between the luminance of the boundary grayscale value and the luminance of the minimum grayscale value may be maintained equal to or less than the predetermined level so that the flicker due to the difference of the luminance of the boundary grayscale value and the luminance of the minimum grayscale value may be prevented. In addition, the decrease of the resolution for displaying the target grayscale value generated due to the digital driving method may be minimized.

BRIEF DESCRIPTION OF THE DRAWINGS

The above and other features and advantages of the present inventive concept will become more apparent by describing in detailed embodiments thereof with reference to the accompanying drawings, in which.

DETAILED DESCRIPTION

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Hereinafter, the present inventive concept will be explained in detail with reference to the accompanying drawings.

Figure 1:
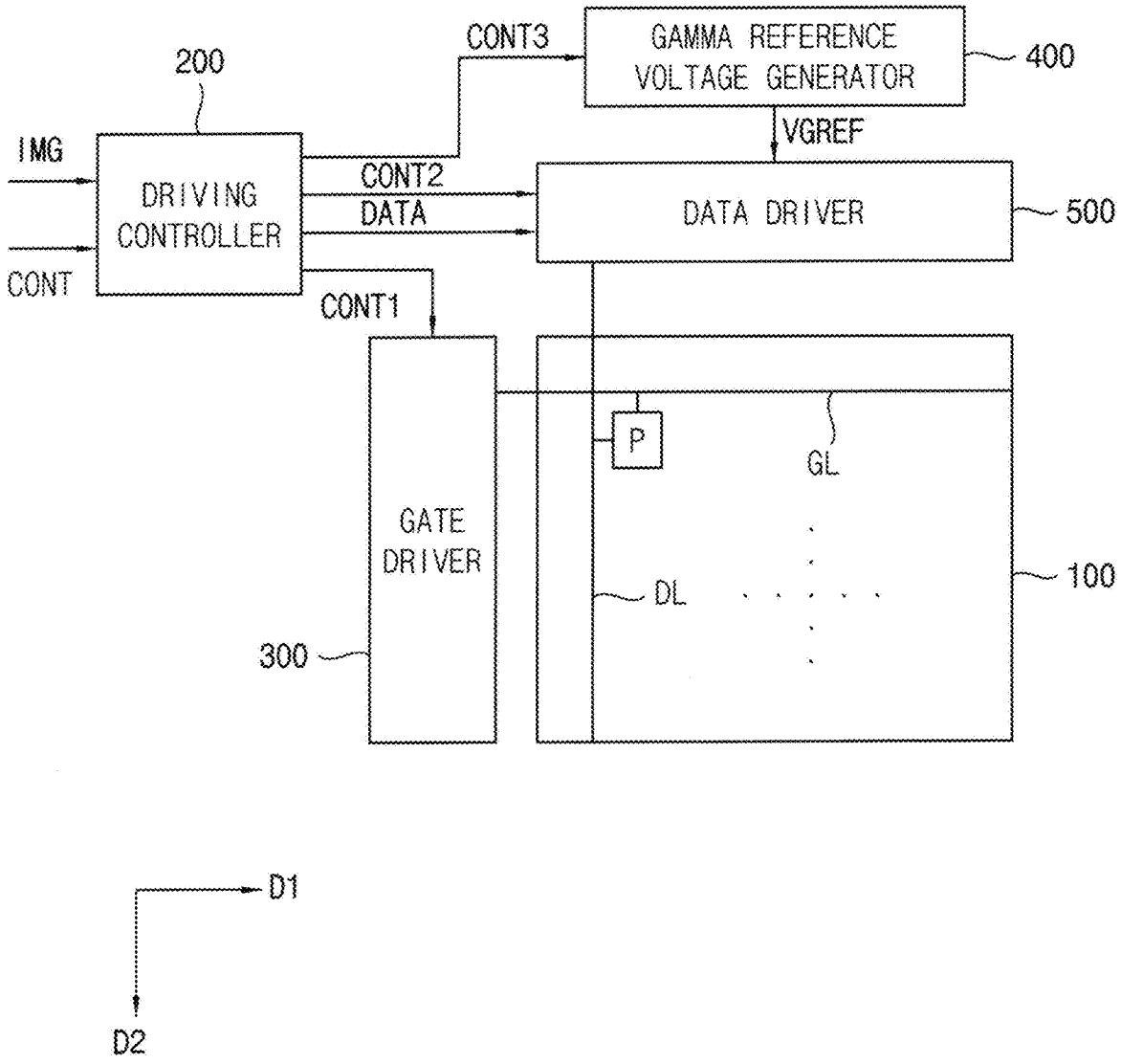
FIG. 1 is a block diagram illustrating a display apparatus according to an embodiment of the present inventive concept.

FIG. 1 is a block diagram illustrating a display apparatus according to an embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500.

In an embodiment, for example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 which are integrally formed may be called to a timing controller embedded data driver ("TED").

The display panel 100 has a display region on which an image is displayed and a peripheral region adjacent to the display region.

The display panel 100 includes a plurality of gate lines GL, a plurality of data lines DL and a plurality of pixels connected to the gate lines GL and the data lines DL. The gate lines GL extend in a first direction D1 and the data lines DL extend in a second direction D2. The second direction D2 crosses the first direction D1.

The driving controller 200 receives input image data IMG and an input control signal CONT from an external apparatus. In an embodiment, the input image data IMG may include red image data, green image data and blue image data. In another embodiment, the input image data IMG may include white image data. In another embodiment, the input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

A structure and an operation of the driving controller 200 are explained referring to FIGS. 2 to 18 in detail.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. For example, the gate driver 300 may be mounted on the peripheral region of the display panel 100. For example, the gate driver 300 may be integrated on the peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
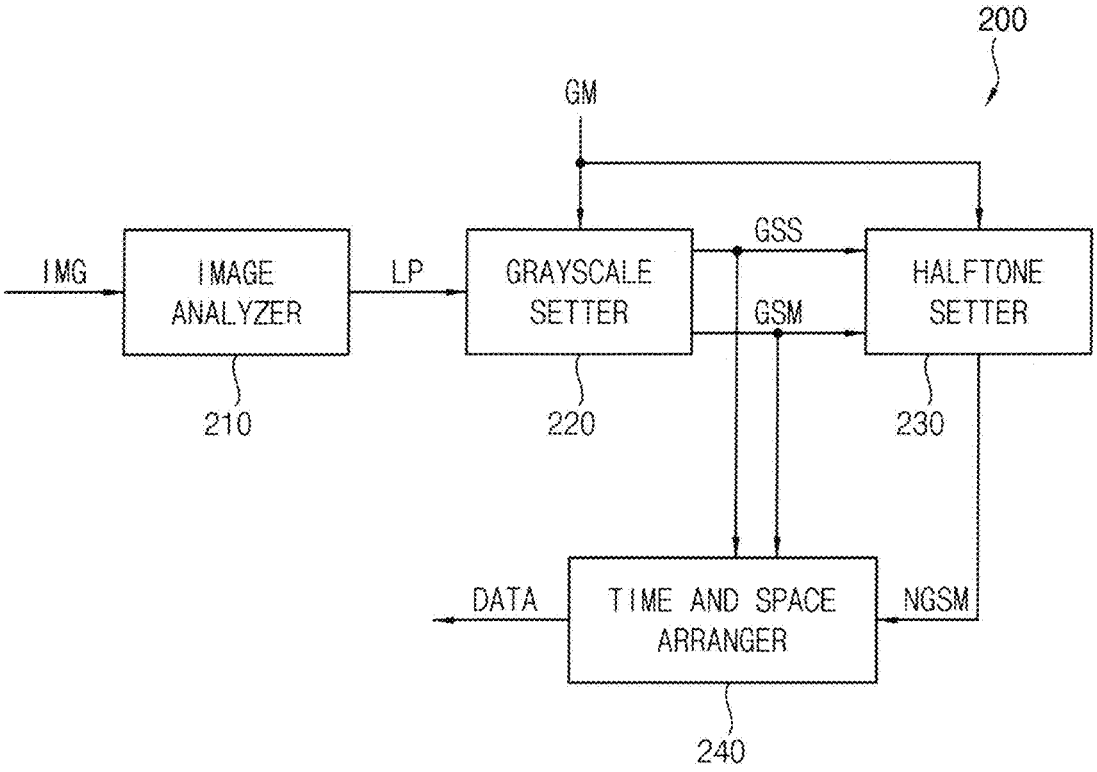
FIG. 2 is a block diagram illustrating a driving controller of FIG. 1.
Figure 3:
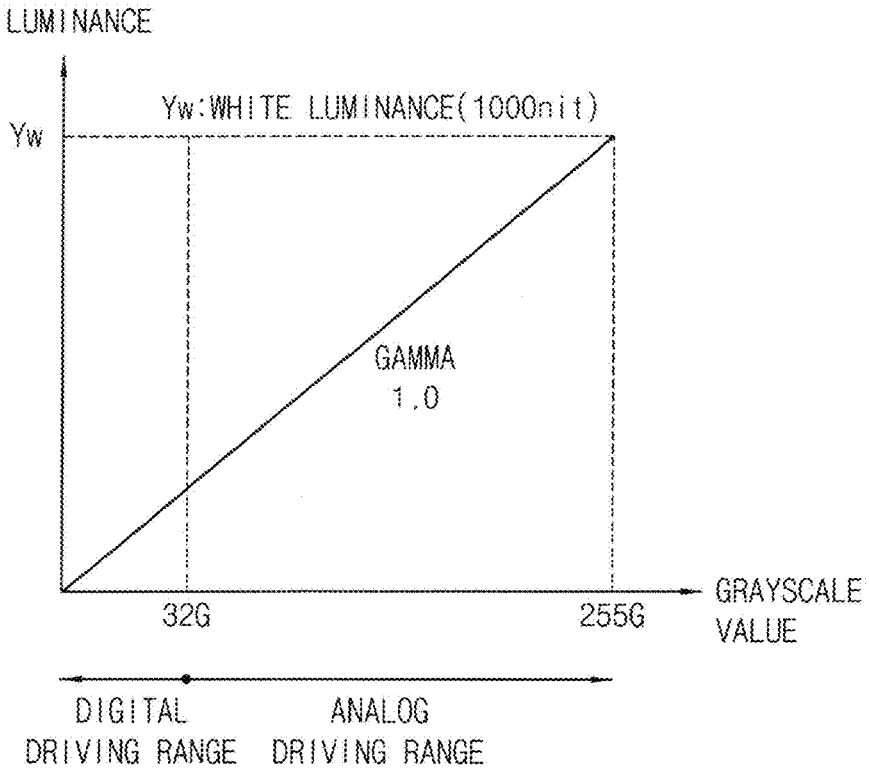
FIG. 3 is a graph illustrating an operation of the driving controller of FIG. 1.
Figure 4:
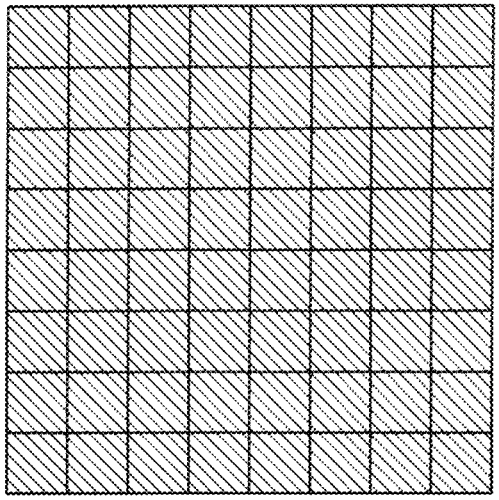
FIG. 4 is a diagram illustrating a method of displaying an image having a grayscale value of 32 on a display panel of FIG. 1.
Figure 5:
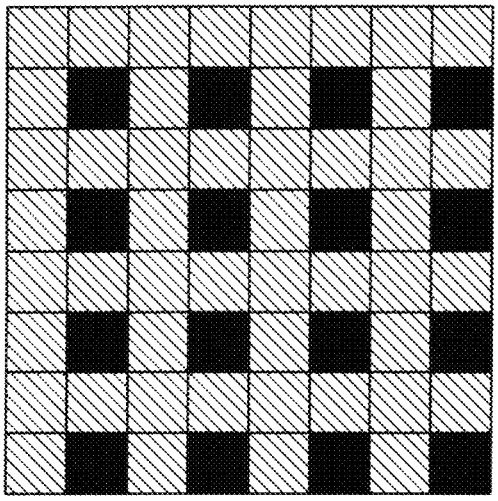
FIG. 5 is a diagram illustrating a method of displaying an image having a grayscale value of 24 on the display panel of FIG. 1.
Figure 6:
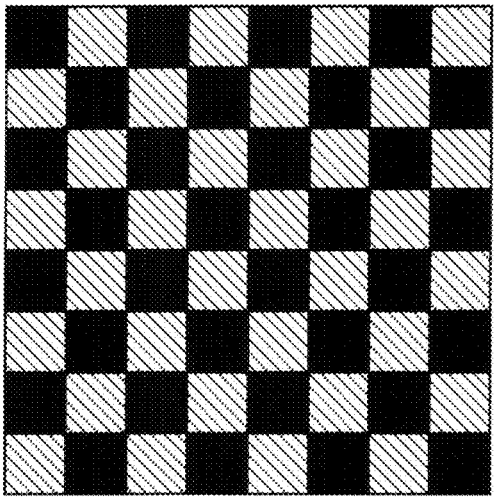
FIG. 6 is a diagram illustrating a method of displaying an image having a grayscale value of 16 on the display panel of FIG. 1.
Figure 7:
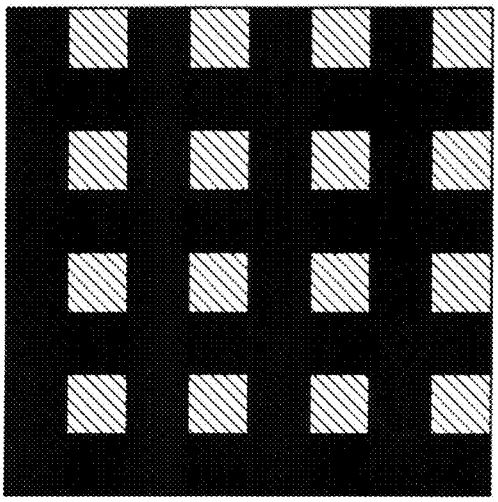
FIG. 7 is a diagram illustrating a method of displaying an image having a grayscale value of 8 on the display panel of FIG. 1.
Figure 8:
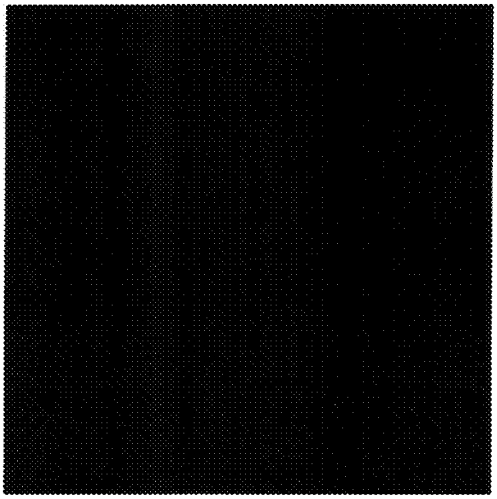
FIG. 8 is a diagram illustrating a method of displaying an image having a grayscale value of 0 on the display panel of FIG. 1.

FIG. 2 is a block diagram illustrating the driving controller 200 of FIG. 1. FIG. 3 is a graph illustrating an operation of the driving controller 200 of FIG. 1. FIG. 4 is a diagram illustrating a method of displaying an image having a grayscale value of 32 on the display panel 100 of FIG. 1. FIG. 5 is a diagram illustrating a method of displaying an image having a grayscale value of 24 on the display panel 100 of FIG. 1. FIG. 6 is a diagram illustrating a method of displaying an image having a grayscale value of 16 on the display panel 100 of FIG. 1. FIG. 7 is a diagram illustrating a method of displaying an image having a grayscale value of 8 on the display panel 100 of FIG. 1. FIG. 8 is a diagram illustrating a method of displaying an image having a grayscale value of 0 on the display panel 100 of FIG. 1.

Referring to FIGS. 1 to 8, the driving controller 200 may drive the display panel 100 in a digital driving method for a low grayscale range which is equal to or less than a boundary grayscale value and drive the display panel 100 in an analog driving method for a normal grayscale range greater than the boundary grayscale value. In the digital driving method, the input grayscale value may be represented using only discrete first data and second data. For example, in the digital driving method, the input grayscale value may be represented by arranging the first data and the second data temporally and spatially. In the analog driving method, the data signal corresponding to the input grayscale value may be determined from among continuous data signals so that the input grayscale value may be represented by the determined data signal. Herein, the data signal may be analog data signal.

The driving controller 200 may include an image analyzer 210, a grayscale setter 220 and a time-and-space arranger 240. The driving controller 200 may further include a halftone setter 230.

The image analyzer 210 may receive the input image data IMG. The image analyzer 210 may analyze the input image data IMG and may determine a peak luminance LP. For example, the image analyzer 210 may determine the peak luminance LP based on a maximum grayscale value of the input image data IMG. For another example, the image analyzer 210 may determine the peak luminance LP based on an average grayscale value of the input image data IMG. The image analyzer 210 may output the peak luminance LP to the grayscale setter 220.

The grayscale setter 220 may receive a gamma value GM and the peak luminance LP. The gamma value GM may be preset by a user or a manufacturer. The grayscale setter 220 may set the boundary grayscale value GSS and a minimum grayscale value GSM. The grayscale setter 220 may output the boundary grayscale value GSS and the minimum grayscale value GSM to the halftone setter 230 and the time-and-space arranger 240.

The boundary grayscale value GSS may represent a grayscale value of a boundary between a digital driving grayscale range and an analog driving grayscale range. The boundary grayscale value GSS and the minimum grayscale value GSM may be reference grayscale values used to drive the digital driving grayscale range. For example, the minimum grayscale value GSM may be 0. However, the minimum grayscale value GSM may not be limited to 0. For example, the minimum grayscale value GSM may be set in a grayscale range greater than 0 and less than the boundary grayscale value GSS. Herein, the minimum grayscale value GSM may be different from a minimum grayscale value of the input image data IMG.

The halftone setter 230 may receive the boundary grayscale value GSS, the minimum grayscale value GSM and the gamma value GM. The halftone setter 230 may set a maximum value NGSM of the number of pixels having the minimum grayscale value GSM based on the boundary grayscale value GSS, the minimum grayscale value GSM and the gamma value GM. The halftone setter 230 may output the maximum value NGSM of the number of pixels having the minimum grayscale value GSM to the time-and-space arranger 240.

The time-and-space arranger 240 may receive the boundary grayscale value GSS and the minimum grayscale value GSM. The time-and-space arranger 240 may generate the data signal DATA corresponding to the input grayscale value in the digital driving grayscale range using only the boundary grayscale value GSS and the minimum grayscale value GSM.

The time-and-space arranger 240 may generate the data signal DATA corresponding to the input grayscale value by temporally and spatially arranging first data having the boundary grayscale value GSS and second data having the minimum grayscale value GSM.

The time-and-space arranger 240 may receive the maximum value NGSM of the number of pixels having the minimum grayscale value GSM from the halftone setter 230. The time-and-space arranger 240 may generate the data signal DATA corresponding to the input grayscale value such that the number of the pixels having the minimum grayscale value GSM does not exceed the maximum value NGSM.

In FIG. 3, for example, the boundary grayscale value GSS may be 32. The data signal DATA may be generated in the digital driving method for the input grayscale value equal to or less than 32. The data signal DATA may be generated in the analog driving method for the input grayscale value greater than 32. In the digital driving method, the input grayscale value may be represented by arranging the first data corresponding to the boundary grayscale value GSS and the second data corresponding to the reference grayscale value GSM temporally and spatially. In the analog driving method, the input grayscale value may be represented using one analog data signal corresponding to the input grayscale value. In FIG. 3, for example, the gamma value GM is 1.0 and the peak luminance LP is 1000 nit as a white luminance Yw.

In FIG. 4, the driving controller 200 may generate only the first data corresponding to the boundary grayscale value (e.g., the grayscale value of 32) to be applied to the pixels to represent the grayscale value of 32.

In FIG. 5, the driving controller 200 may generate the first data corresponding to the boundary grayscale value (e.g., the grayscale value of 32) and the second data corresponding to the minimum grayscale value (e.g., the grayscale value of 0) to be applied to the pixels in a ratio of 3:1 to represent the grayscale value of 24. For example, a position of a pixel representing the first data (e.g., the grayscale value of 32) and a position of a pixel representing the second data (e.g., the grayscale value of 0) may be set to vary for each frame while maintaining the ratio of 3:1 between the first data and the second data.

In FIG. 6, the driving controller 200 may generate the first data corresponding to the boundary grayscale value (e.g., the grayscale value of 32) and the second data corresponding to the minimum grayscale value (e.g., the grayscale value of 0) to be applied to the pixels in a ratio of 1:1 to represent the grayscale value of 16. For example, a position of a pixel representing the first data and a position of a pixel representing the second data may be set to vary for each frame while maintaining the ratio of 1:1 between the first data and the second data.

In FIG. 7, the driving controller 200 may generate the first data corresponding to the boundary grayscale value (e.g., the grayscale value of 32) and the second data corresponding to the minimum grayscale value (e.g., the grayscale value of 0) to be applied to the pixels in a ratio of 1:3 to represent the grayscale value of 8. For example, a position of a pixel representing the first data and a position of a pixel representing the second data may be set to vary for each frame while maintaining the ratio of 1:3 between the first data and the second data.

In FIG. 8, the driving controller 200 may generate only the second data corresponding to the minimum grayscale value (e.g., the grayscale value of 0) to be applied to the pixels to represent the grayscale value of 0.

When a difference of the luminance of the boundary grayscale value GSS (e.g., the grayscale value of 32) and the luminance of the minimum grayscale value GSM (e.g., the grayscale value of 0) is great in the digital driving method as explained in FIGS. 4 to 8, the flicker may be shown to a user. In addition, when the number of the pixels having the minimum grayscale value GSM is great in the digital driving method as explained in FIGS. 4 to 8, the stain due to the image of the minimum grayscale value GSM may be shown to a user.

Although a maximum potential grayscale value of the input image data IMG is 255 (in other words, 255G) in FIGS. 3 to 8, the present inventive concept may not be limited thereto. For example, when the input image data IMG has 8 bits, the maximum potential grayscale value may be 255. For another example, when the input image data IMG has 9 bits, the maximum potential grayscale value may be 511. For still another example, when the input image data IMG has 10 bits, the maximum potential grayscale value may be 1023.

Although the boundary grayscale value GSS is 32 (in other words, 32G) in FIGS. 3 to 8, the boundary grayscale value GSS may not be limited to 32 in the present inventive concept.

Although the peak luminance LP is 1000 nit as a white luminance Yw in FIGS. 3 to 8, the peak luminance LP may not be limited to 1000 nit in the present inventive concept.

Figure 9:
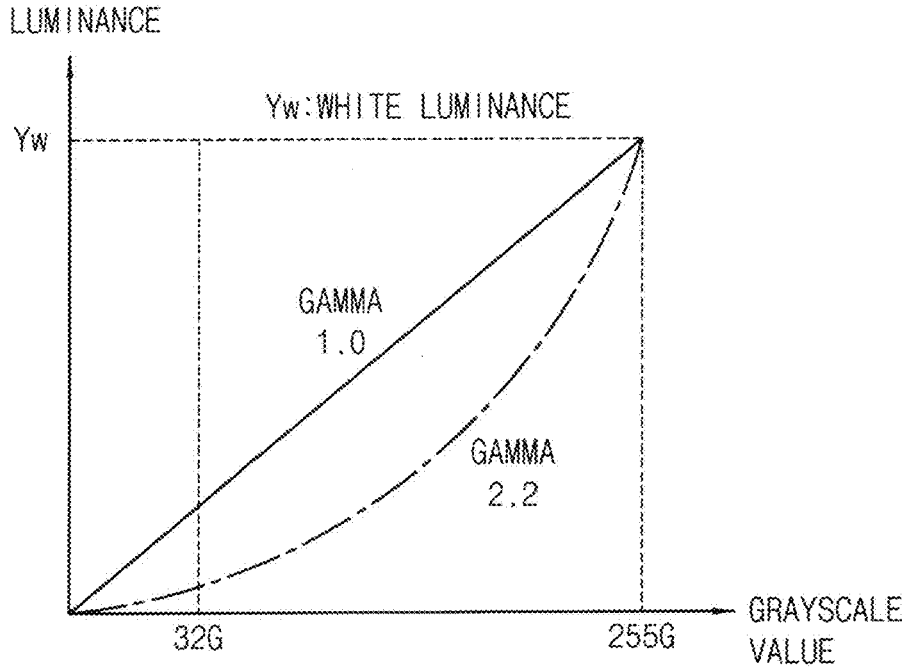
FIG. 9 is a graph illustrating a relationship between a grayscale value and a luminance according to a gamma value inputted to a grayscale setter of FIG. 2.
Figure 10:
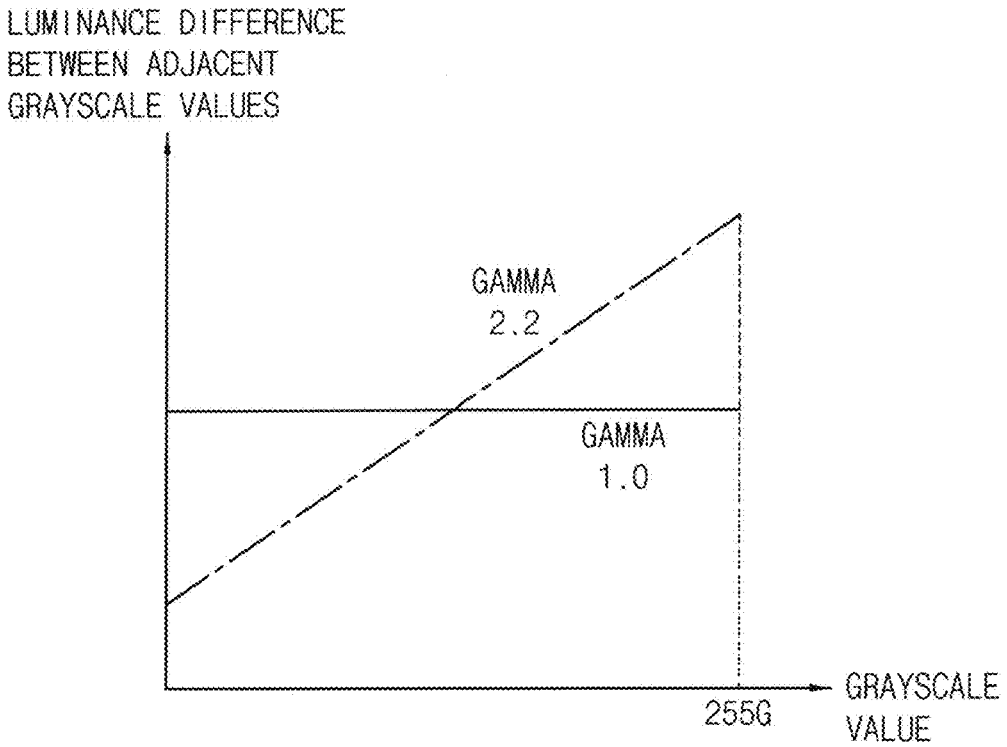
FIG. 10 is a graph illustrating a relationship between the grayscale value and a luminance difference between adjacent grayscale values according to the gamma value inputted to the grayscale setter of FIG. 2.

FIG. 9 is a graph illustrating a relationship between a grayscale value (x-axis) and a luminance (y-axis) according to the gamma value GM inputted to the grayscale setter 220 of FIG. 2. FIG. 10 is a graph illustrating a relationship between the grayscale value (x-axis) and a luminance difference (y-axis) between adjacent grayscale values according to the gamma value GM inputted to the grayscale setter 220 of FIG. 2.

Referring to FIGS. 1 to 10, the grayscale setter 220 may set the boundary grayscale value GSS and the minimum grayscale value GSM such that the difference between the boundary grayscale value GSS and the minimum grayscale value GSM decreases as the gamma value GM decreases.

In FIG. 10, the luminance difference between adjacent grayscale values in the low grayscale range (e.g., the digital driving range) when the gamma value GM is small (e.g., GAMMA 1.0) is greater than the luminance difference between adjacent grayscale values in the low grayscale range when the gamma value GM is great (e.g., GAMMA 2.2). Herein, the luminance difference between adjacent grayscale values means a difference of luminance between a first grayscale value and a second grayscale value that has one level (one grayscale) higher grayscale value than the first grayscale value.

In the present embodiment, the digital driving method is applied only to the low grayscale range so that the luminance difference between adjacent grayscale values may be great as the gamma value decreases in the low grayscale range. When the luminance difference between adjacent grayscale values is great, the difference between the boundary grayscale value GSS and the minimum grayscale value GSM may be set to be small to prevent the flicker in an embodiment.

In an embodiment, the minimum grayscale value GSM may be fixed. For example, the minimum grayscale value GSM may be fixed to the grayscale value of 0. When the minimum grayscale value GSM is fixed, the boundary grayscale value GSS may be decreased as the gamma value GM decreases.

Figure 11:
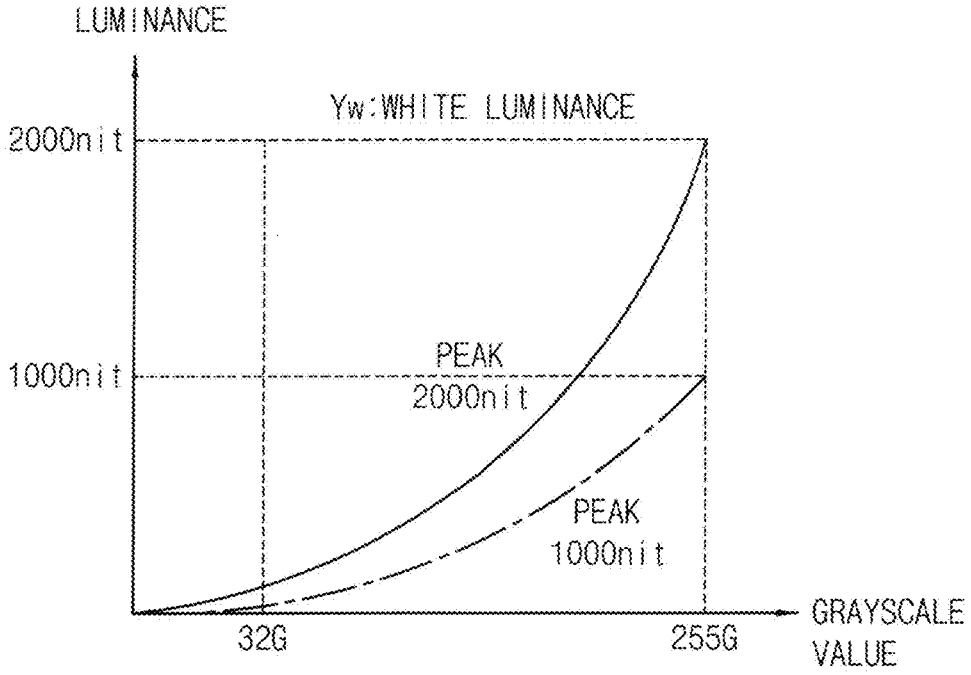
FIG. 11 is a graph illustrating a relationship between the grayscale value and the luminance according to a peak luminance inputted to the grayscale setter of FIG. 2.
Figure 12:
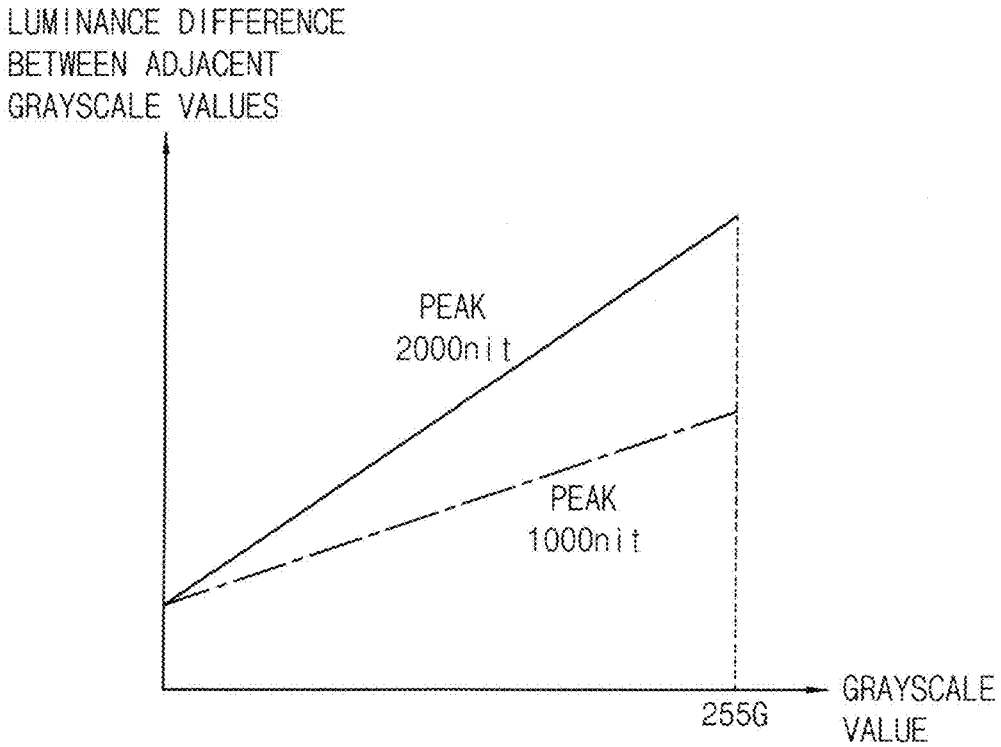
FIG. 12 is a graph illustrating a relationship between the grayscale value and the luminance difference between adjacent grayscale values according to the peak luminance inputted to the grayscale setter of FIG. 2.

FIG. 11 is a graph illustrating a relationship between the grayscale value (x-axis) and the luminance (y-axis) according to the peak luminance LP inputted to the grayscale setter 220 of FIG. 2. FIG. 12 is a graph illustrating a relationship between the grayscale value (x-axis) and the luminance difference (y-axis) between adjacent grayscale values according to the peak luminance LP inputted to the grayscale setter 220 of FIG. 2.

Considering FIGS. 1 to 12, the grayscale setter 220 may set the boundary grayscale value GSS and the minimum grayscale value GSM such that the difference between the boundary grayscale value GSS and the minimum grayscale value GSM is decreased as the peak luminance LP increases.

In FIGS. 11 and 12, the luminance difference between adjacent grayscale values when the peak luminance LP is great (e.g., 2000 nit) may be greater than the luminance difference between adjacent grayscale values when the peak luminance LP is small (e.g., 1000 nit).

As the peak luminance LP increases, the luminance difference between adjacent grayscale values may be increased (See FIG. 12). In an embodiment, when the luminance difference between adjacent grayscale values is great, the difference between the boundary grayscale value GSS and the minimum grayscale value GSM may be set to be small to prevent the flicker.

In an embodiment, the minimum grayscale value GSM may be fixed. For example, the minimum grayscale value GSM may be fixed to the grayscale value of 0. When the minimum grayscale value GSM is fixed, the boundary grayscale value GSS may be set to be decreased as the peak luminance LP increases in an embodiment.

Figure 13:
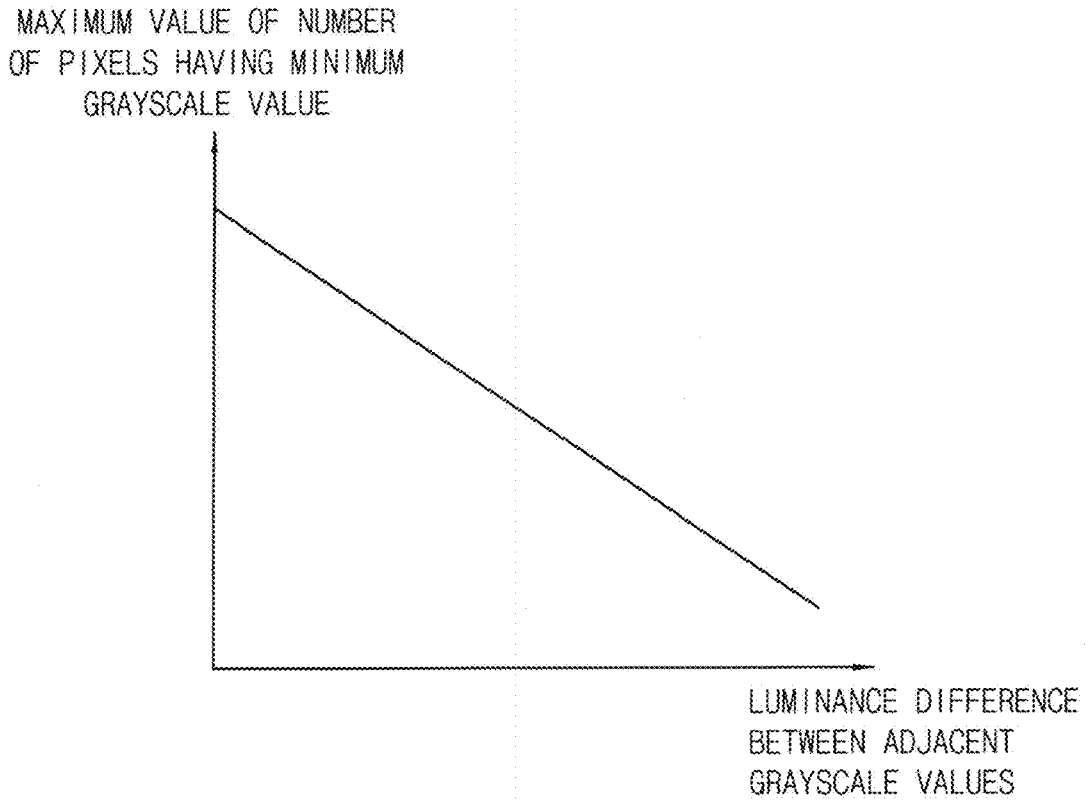
FIG. 13 is a graph illustrating a maximum value of the number of pixels having a minimum grayscale value determined by a halftone setter of FIG. 2 according to the luminance difference between adjacent grayscale values.
Figure 14:
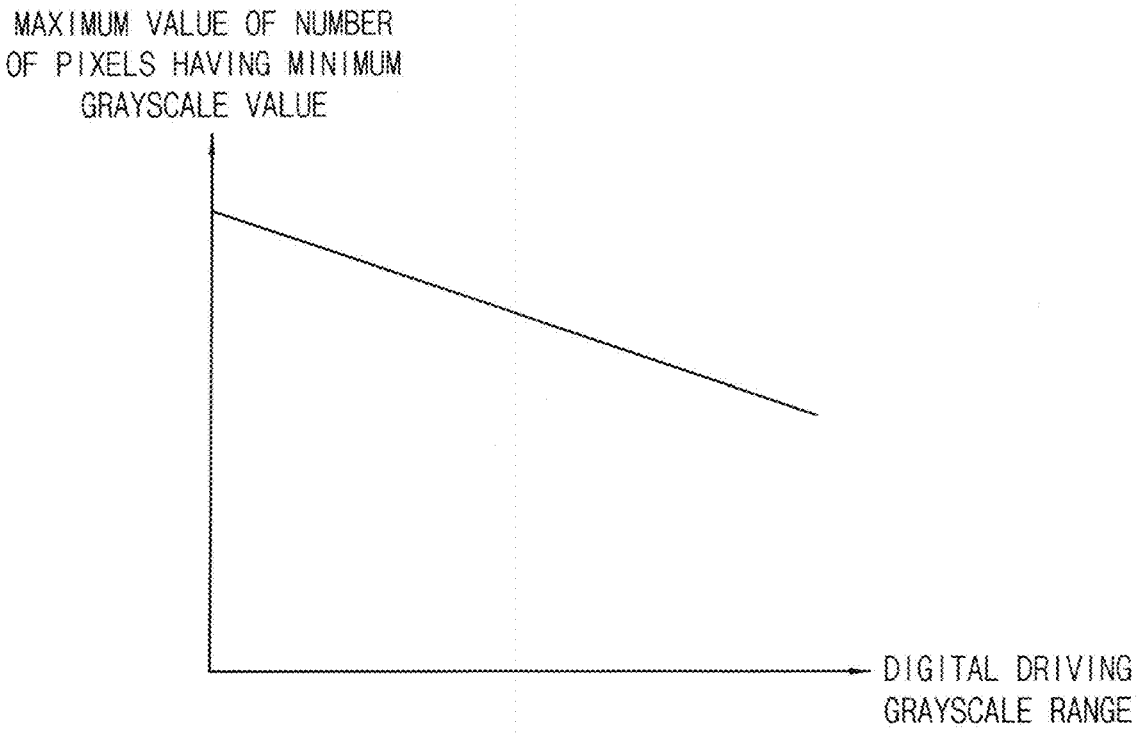
FIG. 14 is a graph illustrating the maximum value of the number of pixels having the minimum grayscale value determined by the halftone setter of FIG. 2 according to a digital driving grayscale range.

FIG. 13 is a graph illustrating the maximum value NGSM (y-axis) of the number of pixels having the minimum grayscale value GSM set by the halftone setter 230 of FIG. 2 according to the luminance difference (x-axis) between adjacent grayscale values. FIG. 14 is a graph illustrating the maximum value NGSM (y-axis) of the number of pixels having the minimum grayscale value GSM set by the halftone setter 230 of FIG. 2 according to the digital driving grayscale range (x-axis).

Referring to FIGS. 1 to 14, the halftone setter 230 may receive the boundary grayscale value GSS, the minimum grayscale value GSM and the gamma value GM. The halftone setter 230 may set the maximum value NGSM of the number of pixels having the minimum grayscale value GSM based on the boundary grayscale value GSS, the minimum grayscale value GSM and the gamma value GM.

As a luminance difference (i.e., digital driving grayscale range in x-axis in FIG. 13) between the boundary grayscale value GSS and the minimum grayscale value GSM increases, the maximum value NGSM of the number of pixels having the minimum grayscale value GSM may be decreased. When the luminance difference between the boundary grayscale value GSS and the minimum grayscale value GSM is great, a possibility of the flicker occurrence may be great so that the maximum value NGSM of the number of pixels having the minimum grayscale value GSM may be set to be small in an embodiment (See FIG. 14). Therefore, as the number of pixels having the minimum grayscale value GSM decreases, the possibility of the flicker occurrence may be decreased.

In addition, as shown in FIG. 13, as the luminance difference between adjacent grayscale values increases, the maximum value NGSM of the number of pixels having the minimum grayscale value GSM may be decreased. As the luminance difference between adjacent grayscale values increases, the possibility of the flicker occurrence may be increased. In an embodiment, the maximum value NGSM of the number of pixels having the minimum grayscale value GSM may be set to be decreased. Therefore, as the number of pixels having the minimum grayscale value GSM decreases, the possibility of the flicker occurrence may be decreased according to the embodiment.

In addition, as shown in FIG. 14, as the digital driving grayscale range (i.e., the difference between the boundary grayscale value GSS and the minimum grayscale value GSM) increases, the maximum value NGSM of the number of pixels having the minimum grayscale value GSM may be decreased. As the digital driving grayscale range increases, the possibility of the flicker occurrence may be increased. In an embodiment, the maximum value NGSM of the number of pixels having the minimum grayscale value GSM may be set to be decreased. Therefore, as the number of pixels having the minimum grayscale value GSM decreases, the possibility of the flicker occurrence may be decreased according to the embodiment.

Figures 15, 16:
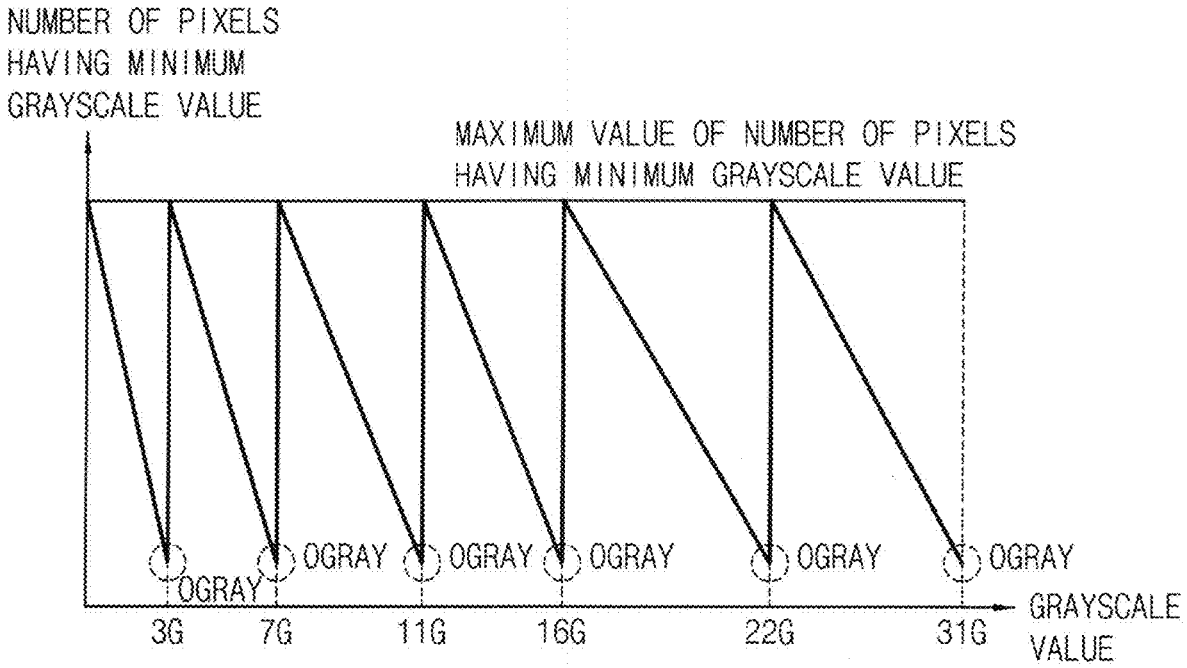
FIG. 15 is a graph illustrating the number of pixels having the minimum grayscale value according to an input grayscale value when the maximum value of number of pixels having the minimum grayscale value determined by the halftone setter of FIG. 2 is fixed and the peak luminance is 1000 nit.
FIG. 16 is a table illustrating the boundary grayscale value and the minimum grayscale value according to the input grayscale value when the maximum value of number of pixels having the minimum grayscale value determined by the halftone setter of FIG. 2 is fixed and the peak luminance is 1000 nit.

FIG. 15 is a graph illustrating the number of pixels having the minimum grayscale value GSM (y-axis) according to an input grayscale value (x-axis) when the maximum value NGSM of number of pixels having the minimum grayscale value GSM set by the halftone setter 230 of FIG. 2 is fixed and the peak luminance is 1000 nit. FIG. 16 is a table illustrating the boundary grayscale value GSS and the minimum grayscale value GSM according to the input grayscale value when the maximum value NGSM of number of pixels having the minimum grayscale value GSM set by the halftone setter 230 of FIG. 2 is fixed and the peak luminance is 1000 nit.

Referring to FIGS. 1 to 16, the grayscale setter 220 may define a plurality of digital driving grayscale ranges. As shown in FIG. 16, the digital driving grayscale ranges may include first to sixth digital driving grayscale ranges.

In an embodiment, for example, the grayscale setter 220 may set a first boundary grayscale value of 32G and a first minimum grayscale value of 0G for a first input grayscale range between 31G and 23G. For example, the grayscale setter 220 may set a second boundary grayscale value of 23G and a second minimum grayscale value of 0G for a second input grayscale range between 22G and 17G which has lower grayscale values than the grayscale values of the first input grayscale range. Herein, the first boundary grayscale value of 32G may represent the grayscale value of the boundary between the analog driving grayscale range and the digital driving grayscale range. The second boundary grayscale value of 23G may represent the grayscale value of the boundary between the first input grayscale range and the second input grayscale range.

The first boundary grayscale value (e.g., 32G) for the first input grayscale range (e.g., the grayscale values between 31G and 23G) may be greater than the second boundary grayscale value (e.g., 23G) for the second input grayscale range (e.g., the grayscale values between 22G and 17G). The first minimum grayscale value (e.g., 0G) for the first input grayscale range (e.g., the grayscale values between 31G and 23G) may be equal to the second minimum grayscale value (e.g., 0G) for the second input grayscale range (e.g., the grayscale values between 22G and 17G).

In an embodiment, for example, the grayscale setter 220 may set a third boundary grayscale value of 17G and a third minimum grayscale value of 0G for a third input grayscale range between 16G and 12G which has lower grayscale values than the grayscale values of the second input grayscale range. For example, the grayscale setter 220 may set a fourth boundary grayscale value of 12G and a fourth minimum grayscale value of 0G for a fourth input grayscale range between 11G and 8G which has lower grayscale values than the grayscale values of the third input grayscale range. For example, the grayscale setter 220 may set a fifth boundary grayscale value of 8G and a fifth minimum grayscale value of 0G for a fifth input grayscale range between 7G and 4G which has lower grayscale values than the grayscale values of the fourth input grayscale range. For example, the grayscale setter 220 may set a sixth boundary grayscale value of 4G and a sixth minimum grayscale value of 0G for a sixth input grayscale range between 3G and 0G which has lower grayscale values than the grayscale values of the fifth input grayscale range.

In the present embodiment, the halftone setter 230 may set the maximum value NGSM of the number of pixels having the minimum grayscale value GSM to be fixed regardless of the input grayscale value of the input image data IMG. In FIG. 15, the NGSM of the number of pixels having the minimum grayscale value GSM is illustrated to be uniform.

The time-and-space arranger 240 may generate the data signal DATA corresponding to the input grayscale value using the boundary grayscale value GSS and the minimum grayscale value GSM such that the number of the pixels having the minimum grayscale value GSM does not exceed the maximum value NGSM.

Figures 17, 18:
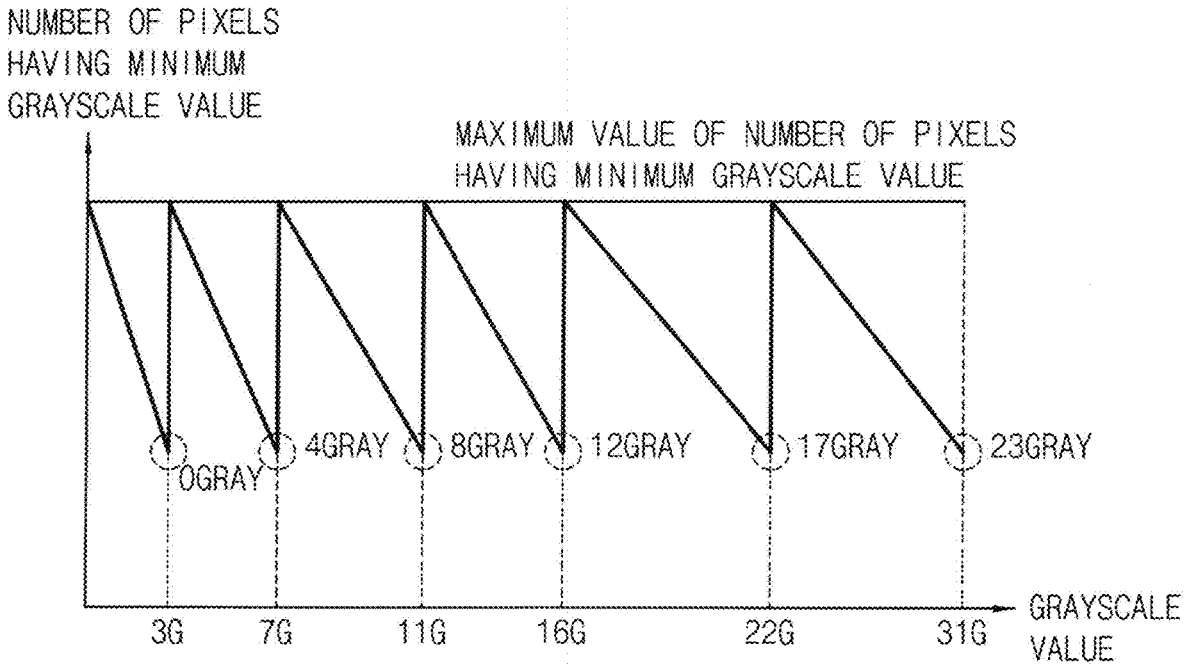
FIG. 17 is a graph illustrating the number of pixels having the minimum grayscale value according to the input grayscale value when the maximum value of number of pixels having the minimum grayscale value determined by the halftone setter of FIG. 2 is fixed and the peak luminance is 2000 nit.
FIG. 18 is a table illustrating the boundary grayscale value and the minimum grayscale value according to the input grayscale value when the maximum value of number of pixels having a minimum grayscale value determined by the halftone setter of FIG. 2 is fixed and the peak luminance is 2000 nit.

FIG. 17 is a graph illustrating the number of pixels having the minimum grayscale value GSM (y-axis) according to the input grayscale value (x-axis) when the maximum value NGSM of number of pixels having the minimum grayscale value GSM set by the halftone setter 230 of FIG. 2 is fixed and the peak luminance is 2000 nit. FIG. 18 is a table illustrating the boundary grayscale value GSS and the minimum grayscale value GSM according to the input grayscale value when the maximum value NGSM of number of pixels having a minimum grayscale value GSM set by the halftone setter 230 of FIG. 2 is fixed and the peak luminance is 2000 nit.

Referring to FIGS. 1 to 18, the grayscale setter 220 may define a plurality of digital driving grayscale ranges. As shown in FIG. 18, the digital driving grayscale ranges may include first to sixth digital driving grayscale ranges.

In an embodiment, for example, the grayscale setter 220 may set a first boundary grayscale value of 32G and a first minimum grayscale value of 23G for a first input grayscale range between 31G and 23G. For example, the grayscale setter 220 may set a second boundary grayscale value of 23G and a second minimum grayscale value of 17G for a second input grayscale range between 22G and 17G which has lower grayscale values than the grayscale values of the first input grayscale range.

The first boundary grayscale value (e.g., 32G) for the first input grayscale range (e.g., the grayscale values between 31G and 23G) may be greater than the second boundary grayscale value (e.g., 23G) for the second input grayscale range (e.g., the grayscale values between 22G and 17G). The first minimum grayscale value (e.g., 23G) for the first input grayscale range (e.g., the grayscale values between 31G and 23G) may be greater than the second minimum grayscale value (e.g., 17G) for the second input grayscale range (e.g., the grayscale values between 22G and 17G).

In an embodiment, for example, the grayscale setter 220 may set a third boundary grayscale value of 17G and a third minimum grayscale value of 12G for a third input grayscale range between 16G and 12G which has lower grayscale values than the grayscale values of the second input grayscale range. For example, the grayscale setter 220 may set a fourth boundary grayscale value of 12G and a fourth minimum grayscale value of 8G for a fourth input grayscale range between 11G and 8G which has lower grayscale values than the grayscale values of the third input grayscale range. For example, the grayscale setter 220 may set a fifth boundary grayscale value of 8G and a fifth minimum grayscale value of 4G for a fifth input grayscale range between 7G and 4G which has lower grayscale values than the grayscale values of the fourth input grayscale range. For example, the grayscale setter 220 may set a sixth boundary grayscale value of 4G and a sixth minimum grayscale value of 0G for a sixth input grayscale range between 3G and 0G which has lower grayscale values than the grayscale values of the fifth input grayscale range.

In the present embodiment, the halftone setter 230 may set the maximum value NGSM of the number of pixels having the minimum grayscale value GSM to be fixed regardless of the input grayscale value of the input image data IMG. In FIG. 17, the NGSM of the number of pixels having the minimum grayscale value GSM is illustrated to be uniform.

The time-and-space arranger 240 may generate the data signal DATA corresponding to the input grayscale value using the boundary grayscale value GSS and the minimum grayscale value GSM such that the number of the pixels having the minimum grayscale value GSM does not exceed the maximum value NGSM.

According to the present embodiment, the display panel 100 may be driven in the digital driving method corresponding to the low grayscale range, the display panel 100 may be driven in the analog driving method corresponding to the normal grayscale range which is not the low grayscale range, and the boundary grayscale value GSS representing the grayscale value of the boundary of the low grayscale range and the normal grayscale range and the minimum grayscale value GSM may be set adaptively.

Thus, the difference between the luminance of the boundary grayscale value GSS and the luminance of the minimum grayscale value GSM may be maintained equal to or less than the predetermined level so that the flicker due to the difference of the luminance of the boundary grayscale value GSS and the luminance of the minimum grayscale value GSM may be prevented in this embodiment. In addition, the decrease of the resolution for displaying the target grayscale value generated due to the digital driving method may be effectively minimized.

Figures 19, 20:
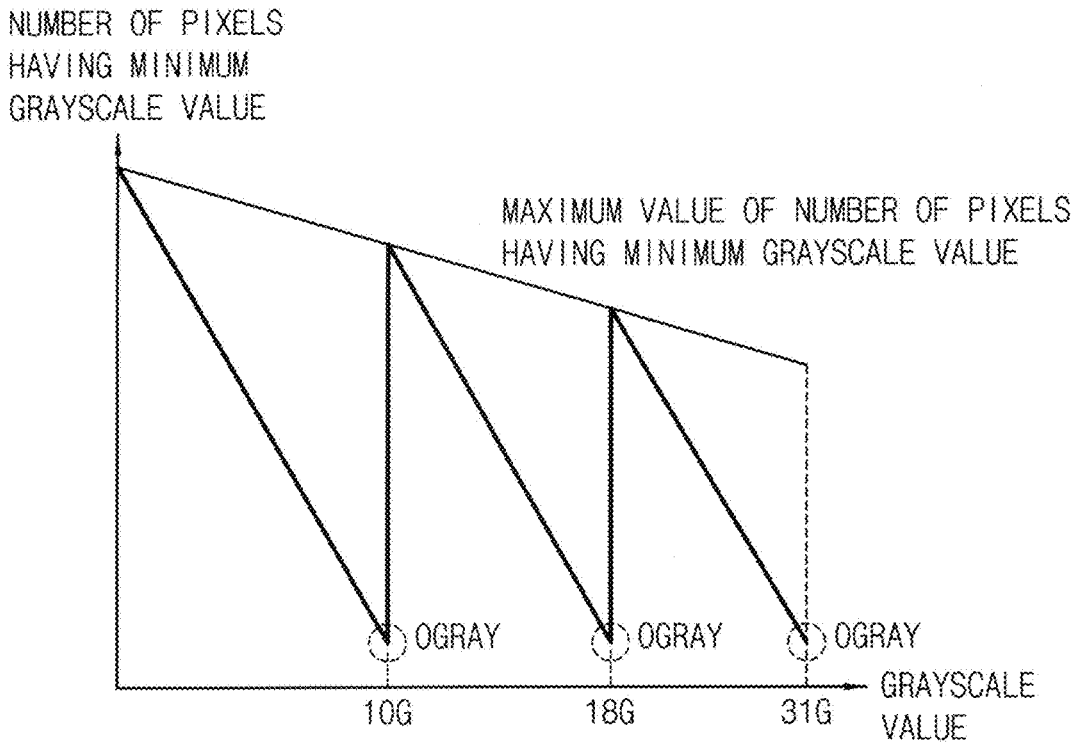
FIG. 19 is a graph illustrating the number of pixels having the minimum grayscale value according to the input grayscale value when the maximum value of number of pixels having the minimum grayscale value determined by the halftone setter of FIG. 2 is varied according to the input grayscale value and the peak luminance is 1000 nit.
FIG. 20 is a table illustrating the boundary grayscale value and the minimum grayscale value according to the input grayscale value when the maximum value of number of pixels having the minimum grayscale value determined by the halftone setter of FIG. 2 is varied according to the input grayscale value and the peak luminance is 1000 nit.

FIG. 19 is a graph illustrating the number of pixels having the minimum grayscale value GSM (y-axis) according to the input grayscale value (x-axis) when the maximum value NGSM of number of pixels having the minimum grayscale value GSM set by the halftone setter 230 of FIG. 2 is varied according to the input grayscale value and the peak luminance LP is 1000 nit. FIG. 20 is a table illustrating the boundary grayscale value GSS and the minimum grayscale value GSM according to the input grayscale value when the maximum value NGSM of number of pixels having the minimum grayscale value GSM set by the halftone setter 230 of FIG. 2 is varied according to the input grayscale value and the peak luminance LP is 1000 nit.

Referring to FIGS. 1 to 14, 19 and 20, the grayscale setter 220 may define a plurality of digital driving grayscale ranges. As shown in FIG. 20, the digital driving grayscale ranges may include first to third digital driving grayscale ranges.

In an embodiment, for example, the grayscale setter 220 may set a first boundary grayscale value of 32G and a first minimum grayscale value of 0G for a first input grayscale range between 31G and 19G. For example, the grayscale setter 220 may set a second boundary grayscale value of 19G and a second minimum grayscale value of 0G for a second input grayscale range between 18G and 11G which has lower grayscale values than the grayscale values of the first input grayscale range. Herein, the first boundary grayscale value of 32G may represent the grayscale value of the boundary between the analog driving grayscale range and the digital driving grayscale range. The second boundary grayscale value of 19G may represent the grayscale value of the boundary between the first input grayscale range and the second input grayscale range.

The first boundary grayscale value (e.g., 32G) for the first input grayscale range (e.g., the grayscale values between 31G and 19G) may be greater than the second boundary grayscale value (e.g., 19G) for the second input grayscale range (e.g., the grayscale values between 18G and 11G). The first minimum grayscale value (e.g., 0G) for the first input grayscale range (e.g., the grayscale values between 31G and 19G) may be equal to the second minimum grayscale value (e.g., 0G) for the second input grayscale range (e.g., the grayscale values between 18G and 11G).

In an embodiment, for example, the grayscale setter 220 may set a third boundary grayscale value of 11G and a third minimum grayscale value of 0G for a third input grayscale range between 10G and 0G which has lower grayscale values than the grayscale values of the second input grayscale range.

In the present embodiment, the halftone setter 230 may set the maximum value NGSM of the number of pixels having the minimum grayscale value GSM to be varied according to the input grayscale value of the input image data IMG. In FIG. 19, the NGSM of the number of pixels having the minimum grayscale value GSM is illustrated to be varied. For example, as the input grayscale value of the input image data IMG decreases, the maximum value NGSM of the number of pixels having the minimum grayscale value GSM may be increased.

The time-and-space arranger 240 may generate the data signal DATA corresponding to the input grayscale value using the boundary grayscale value GSS and the minimum grayscale value GSM such that the number of the pixels having the minimum grayscale value GSM does not exceed the maximum value NGSM.

Figures 21, 22:
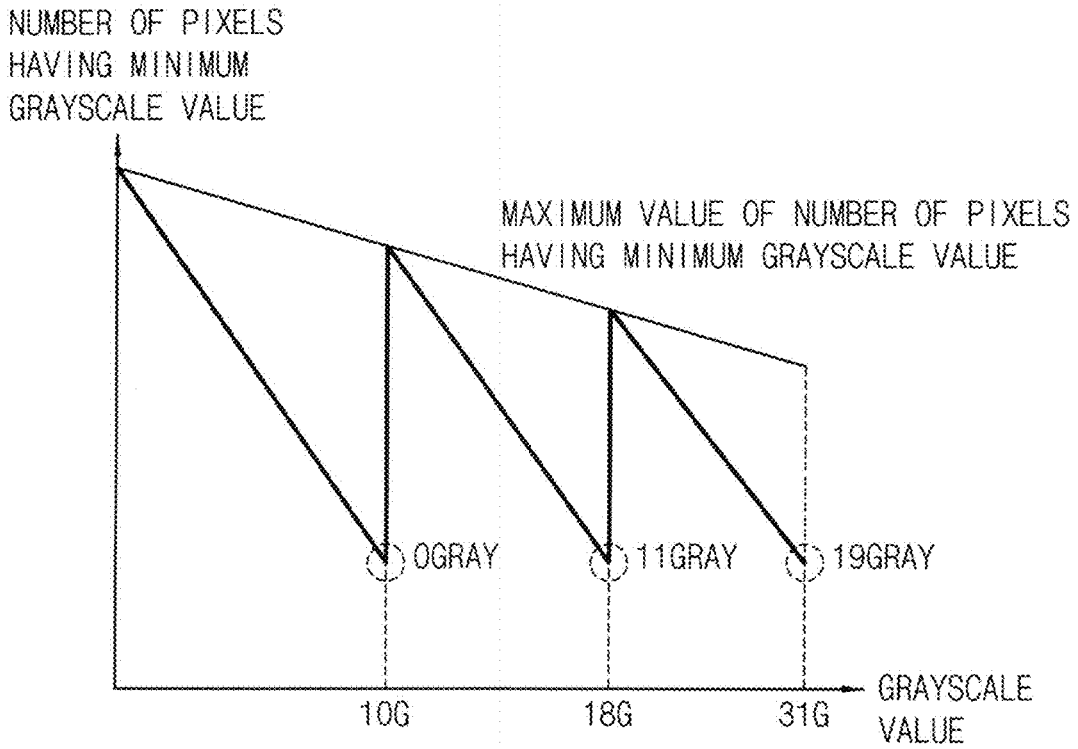
FIG. 21 is a graph illustrating the number of pixels having the minimum grayscale value according to the input grayscale value when the maximum value of number of pixels having the minimum grayscale value determined by the halftone setter of FIG. 2 is varied according to the input grayscale value and the peak luminance is 2000 nit.
FIG. 22 is a table illustrating the boundary grayscale value and the minimum grayscale value according to the input grayscale value when the maximum value of number of pixels having the minimum grayscale value determined by the halftone setter of FIG. 2 is varied according to the input grayscale value and the peak luminance is 2000 nit.

FIG. 21 is a graph illustrating the number of pixels having the minimum grayscale value GSM (y-axis) according to the input grayscale value (x-axis) when the maximum value NGSM of number of pixels having the minimum grayscale value GSM set by the halftone setter 230 of FIG. 2 is varied according to the input grayscale value and the peak luminance LP is 2000 nit. FIG. 22 is a table illustrating the boundary grayscale value GSS and the minimum grayscale value GSM according to the input grayscale value when the maximum value of number of pixels having the minimum grayscale value GSM set by the halftone setter 230 of FIG. 2 is varied according to the input grayscale value and the peak luminance LP is 2000 nit.

Referring to FIGS. 1 to 14, 19 to 22, the grayscale setter 220 may define a plurality of digital driving grayscale ranges. As shown in FIG. 22, the digital driving grayscale ranges may include first to third digital driving grayscale ranges.

In an embodiment, for example, the grayscale setter 220 may set a first boundary grayscale value of 32G and a first minimum grayscale value of 19G for a first input grayscale range between 31G and 19G. For example, the grayscale setter 220 may set a second boundary grayscale value of 19G and a second minimum grayscale value of 11G for a second input grayscale range between 18G and 11G which has lower grayscale values than the grayscale values of the first input grayscale range. Herein, the first boundary grayscale value of 32G may represent the grayscale value of the boundary between the analog driving grayscale range and the digital driving grayscale range. The second boundary grayscale value of 19G may represent the grayscale value of the boundary between the first input grayscale range and the second input grayscale range.

The first boundary grayscale value (e.g., 32G) for the first input grayscale range (e.g., the grayscale values between 31G and 19G) may be greater than the second boundary grayscale value (e.g., 19G) for the second input grayscale range (e.g., the grayscale values between 18G and 11G). The first minimum grayscale value (e.g., 19G) for the first input grayscale range (e.g., the grayscale values between 31G and 19G) may be greater than the second minimum grayscale value (e.g., 11G) for the second input grayscale range (e.g., the grayscale values between 18G and 11G).

In an embodiment, for example, the grayscale setter 220 may set a third boundary grayscale value of 11G and a third minimum grayscale value of 0G for a third input grayscale range between 10G and 0G which has lower grayscale values than the grayscale values of the second input grayscale range.

In the present embodiment, the halftone setter 230 may set the maximum value NGSM of the number of pixels having the minimum grayscale value GSM to be varied according to the input grayscale value of the input image data IMG. In FIG. 21, the NGSM of the number of pixels having the minimum grayscale value GSM is illustrated to be varied. For example, as the input grayscale value of the input image data IMG decreases, the maximum value NGSM of the number of pixels having the minimum grayscale value GSM may be increased.

The time-and-space arranger 240 may generate the data signal DATA corresponding to the input grayscale value using the boundary grayscale value GSS and the minimum grayscale value GSM such that the number of the pixels having the minimum grayscale value GSM does not exceed the maximum value NGSM.

According to the present embodiment, the display panel 100 may be driven in the digital driving method corresponding to the low grayscale range, the display panel 100 may be driven in the analog driving method corresponding to the normal grayscale range which is not the low grayscale range, and the boundary grayscale value GSS representing the grayscale value of the boundary of the low grayscale range and the normal grayscale range and the minimum grayscale value GSM may be set adaptively.

Thus, the difference between the luminance of the boundary grayscale value GSS and the luminance of the minimum grayscale value GSM may be maintained equal to or less than the predetermined level so that the flicker due to the difference of the luminance of the boundary grayscale value GSS and the luminance of the minimum grayscale value GSM may be effectively prevented in this embodiment. In addition, the decrease of the resolution for displaying the target grayscale value generated due to the digital driving method may be minimized.

Figure 23:
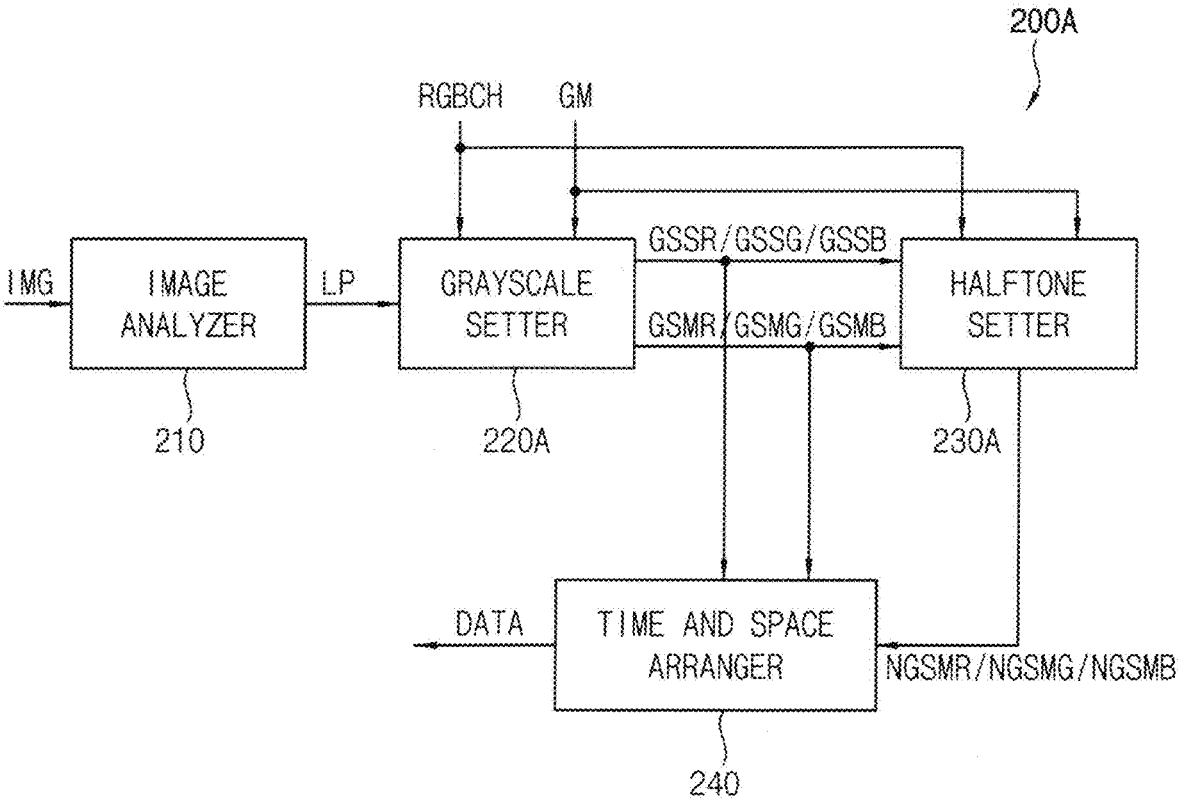
FIG. 23 is a block diagram illustrating a driving controller of a display apparatus according to another embodiment of the present inventive concept.

FIG. 23 is a block diagram illustrating a driving controller 200A of a display apparatus according to another embodiment of the present inventive concept.

The driving controller, the display apparatus and the method of driving the display panel according to the present embodiment is substantially the same as the driving controller, the display apparatus and the method of driving the display panel of the previous embodiment explained referring to FIGS. 1 to 18 except for the structure and the operation of the driving controller. Thus, the same reference numerals will be used to refer to the same or like parts as those described in the previous embodiment of FIGS. 1 to 18 and any repetitive explanation concerning the above elements will be omitted.

Referring to FIGS. 1 and 23, the display apparatus a display panel 100 and a display panel driver. The display panel driver includes a driving controller 200A, a gate driver 300, a gamma reference voltage generator 400 and a data driver 500.

The driving controller 200A may drive the display panel 100 in a digital driving method for a low grayscale range which is equal to or less than a boundary grayscale value and drive the display panel 100 in an analog driving method for a normal grayscale range greater than the boundary grayscale value.

The driving controller 200A may include an image analyzer 210, a grayscale setter 220A and a time-and-space arranger 240. The driving controller 200A may further include a halftone setter 230A.

The image analyzer 210 may receive the input image data IMG. The image analyzer 210 may analyze the input image data IMG and may determine a peak luminance LP. For example, the image analyzer 210 may determine the peak luminance LP based on a maximum grayscale value of the input image data IMG. The image analyzer 210 may output the peak luminance LP to the grayscale setter 220A.

The grayscale setter 220A may receive a gamma value GM and the peak luminance LP. The grayscale setter 220A may further receive characteristic values RGBCH of a red subpixel, a green subpixel and a blue subpixel. The characteristic values RGBCH of the red subpixel, the green subpixel and the blue subpixel may include a luminance difference between adjacent grayscale values of the red subpixel, a luminance difference between adjacent grayscale values of the green subpixel and a luminance difference between adjacent grayscale values of the blue subpixel.

The grayscale setter 220A may set boundary grayscale values GSSR, GSSG and GSSB of the red subpixel, the green subpixel and the blue subpixel and the minimum grayscale values GSMR, GSMG and GSMB of the red subpixel, the green subpixel and the blue subpixel based on the characteristic values RGBCH of the red subpixel, the green subpixel and the blue subpixel, the gamma value GM and the peak luminance LP, respectively. The grayscale setter 220A may output the boundary grayscale values GSSR, GSSG and GSSB and the minimum grayscale values GSMR, GSMG and GSMB to the halftone setter 230A and the time-and-space arranger 240.

The halftone setter 230A may receive the characteristic values RGBCH of the red subpixel, the green subpixel and the blue subpixel, the boundary grayscale values GSSR, GSSG and GSSB, the minimum grayscale values GSMR, GSMG and GSMB and the gamma value GM. The halftone setter 230A may set a maximum value NGSMR, NGSMG and NGSMB of the number of pixels having the minimum grayscale value GSMR, GSMG and GSMB based on the boundary grayscale value GSS, the minimum grayscale value GSM and the gamma value GM. The halftone setter 230A may output the maximum value NGSMR, NGSMG and NGSMB of the number of pixels having the minimum grayscale value GSMR, GSMG and GSMB to the time-and-space arranger 240.

According to the present embodiment, the display panel 100 may be driven in the digital driving method corresponding to the low grayscale range, the display panel 100 may be driven in the analog driving method corresponding to the normal grayscale range which is not the low grayscale range, and the boundary grayscale value GSSR, GSSG and GSSB representing the grayscale value of the boundary of the low grayscale range and the normal grayscale range and the minimum grayscale value GSMR, GSMG and GSMB may be set adaptively.

Thus, the difference between the luminance of the boundary grayscale value GSSR, GSSG and GSSB and the luminance of the minimum grayscale value GSMR, GSMG and GSMB may be maintained equal to or less than the predetermined level so that the flicker due to the difference of the luminance of the boundary grayscale value GSSR, GSSG and GSSB and the luminance of the minimum grayscale value GSMR, GSMG and GSMB may be effectively prevented by the embodiment. In addition, the decrease of the resolution for displaying the target grayscale value generated due to the digital driving method may be minimized.

According to the driving controller, the display apparatus and the method of driving the display panel of the present embodiment, the display quality of the display panel may be enhanced.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein.

What is claimed is:

1. A driving controller comprising:

an image analyzer which analyzes input image data to determine a peak luminance;

a grayscale setter which receives a gamma value and the peak luminance and sets a boundary grayscale value and a minimum grayscale value; and a time-and-space arranger which temporally and spatially arranges first data having the boundary grayscale value and second data having the minimum grayscale value, wherein the driving controller is configured to drive a display panel using the first data and the second data for a low grayscale range of which a grayscale is equal to or less than the boundary grayscale value and to drive the display panel based on a data signal corresponding to a grayscale value of the input image data for a normal grayscale range of which a grayscale is greater than the boundary grayscale value.

2. The driving controller of claim 1, wherein the grayscale setter is configured to set the boundary grayscale value and the minimum grayscale value such that a difference between the boundary grayscale value and the minimum grayscale value is decreased as the peak luminance increases.

3. The driving controller of claim 2, wherein the minimum grayscale value is fixed, and wherein the boundary grayscale value is set to be decreased by the grayscale setter as the peak luminance increases.

4. The driving controller of claim 1, wherein the grayscale setter is configured to set the boundary grayscale value and the minimum grayscale value such that a difference between the boundary grayscale value and the minimum grayscale value is decreased as the gamma value decreases.

5. The driving controller of claim 4, wherein the minimum grayscale value is fixed, and wherein the boundary grayscale value is decreased as the gamma value decreases.

6. The driving controller of claim 1, wherein the grayscale setter is configured to define a plurality of digital driving grayscale ranges, wherein the grayscale setter is configured to set a first boundary grayscale value and a first minimum grayscale value for a first input grayscale range, and wherein the grayscale setter is configured to set a second boundary grayscale value and a second minimum grayscale value for a second input grayscale range which has lower grayscale values than grayscale values of the first input grayscale range.

7. The driving controller of claim 6, wherein the first boundary grayscale value is greater than the second boundary grayscale value.

8. The driving controller of claim 7, wherein the first minimum grayscale value is equal to the second minimum grayscale value.

9. The driving controller of claim 7, wherein the first minimum grayscale value is greater than the second minimum grayscale value.

10. The driving controller of claim 1, further comprising a halftone setter which sets a maximum value of a number of pixels having the minimum grayscale value based on the boundary grayscale value, the minimum grayscale value and the gamma value.

11. The driving controller of claim 10, wherein the maximum value of the number of pixels having the minimum grayscale value is decreased as a luminance difference of the boundary grayscale value and the minimum grayscale value increases.

12. The driving controller of claim 10, wherein the grayscale setter is configured to define a plurality of digital driving grayscale ranges, wherein the grayscale setter is configured to set a first boundary grayscale value and a first minimum grayscale value for a first input grayscale range, and wherein the grayscale setter is configured to set a second boundary grayscale value and a second minimum grayscale value for a second input grayscale range which has lower grayscale values than grayscale values of the first input grayscale range.

13. The driving controller of claim 12, wherein the halftone setter is configured to set the maximum value of the number of pixels having the minimum grayscale value to be fixed regardless of an input grayscale value of the input image data.

14. The driving controller of claim 12, wherein the halftone setter is configured to set the maximum value of the number of pixels having the minimum grayscale value to be varied according to an input grayscale value of the input image data.

15. The driving controller of claim 14, wherein the maximum value of the number of pixels having the minimum grayscale value is increased as the input grayscale value of the input image data decreases.

16. The driving controller of claim 1, wherein the grayscale setter is configured to further receive characteristic values of a red subpixel, a green subpixel and a blue subpixel, wherein the grayscale setter is configured to set boundary grayscale values of the red subpixel, the green subpixel and the blue subpixel and the minimum grayscale values of the red subpixel, the green subpixel and the blue subpixel based on the gamma value, the peak luminance and the characteristic values of the red subpixel, the green subpixel and the blue subpixel, respectively.

17. The driving controller of claim 16, further comprising a halftone setter which sets a maximum value of the number of pixels having the minimum grayscale value of the red subpixel, a maximum value of the number of pixels having the minimum grayscale value of the green subpixel and a maximum value of the number of pixels having the minimum grayscale value of the blue subpixel based on the boundary grayscale values of the red subpixel, the green subpixel and the blue subpixel, the minimum grayscale values of the red subpixel, the green subpixel and the blue subpixel and the gamma value.

18. A display apparatus comprising:

a display panel which displays an image based on input image data;

a gate driver which outputs a gate signal to the display panel;

a driving controller which analyzes input image data to determine a peak luminance, set a boundary grayscale value and a minimum grayscale value based on a gamma value and the peak luminance, temporally and spatially arranges first data having the boundary grayscale value and second data having the minimum grayscale value to generate a data signal, drives the display panel for a low grayscale range in a digital driving method and drives the display panel for a normal grayscale range of which a grayscale is greater than the boundary grayscale value in an analog driving method, wherein the boundary grayscale value is a grayscale value of a boundary between the normal grayscale range and the normal grayscale range; and a data driver which generates a data voltage based on the data signal and outputs the data voltage to the display panel.

19. The display apparatus of claim 18, wherein the driving controller is configured to set a maximum value of a number of pixels having the minimum grayscale value based on the boundary grayscale value, the minimum grayscale value and the gamma value.

20. A method of driving a display panel, the method comprising:

analyzing input image data to determine a peak luminance;

setting a boundary grayscale value and a minimum grayscale value based on a gamma value and the peak luminance; and temporally and spatially arranging first data having the boundary grayscale value and second data having the minimum grayscale value to generate a data signal.

21. The method of claim 20, further comprising converting the data signal into a data voltage; and outputting the data voltage to the display panel.

22. The method of claim 20, wherein the boundary grayscale value and the minimum grayscale value are set such that a difference between the boundary grayscale value and the minimum grayscale value is decreased as the peak luminance increases.

23. The method of claim 22, wherein the minimum grayscale value is fixed, and wherein the boundary grayscale value is decreased as the peak luminance increases.

24. The method of claim 20, wherein the boundary grayscale value and the minimum grayscale value are set such that a difference between the boundary grayscale value and the minimum grayscale value is decreased as the gamma value decreases.

25. The method of claim 24, wherein the minimum grayscale value is fixed, and wherein the boundary grayscale value is decreased as the gamma value decreases.

* * * * *